US009710009B2

(12) United States Patent
Ideno et al.

(10) Patent No.: US 9,710,009 B2
(45) Date of Patent: Jul. 18, 2017

(54) REGULATOR AND SEMICONDUCTOR INTEGRATED CIRCUIT

(71) Applicant: Kabushiki Kaisha Toshiba, Minato-ku (JP)

(72) Inventors: Hiroyuki Ideno, Yokohama (JP); Hidefumi Kushibe, Kamakura (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 0 days.

(21) Appl. No.: 14/847,713

(22) Filed: Sep. 8, 2015

(65) Prior Publication Data

US 2016/0266599 A1 Sep. 15, 2016

Related U.S. Application Data

(60) Provisional application No. 62/133,125, filed on Mar. 13, 2015.

(51) Int. Cl.
*G05F 3/30* (2006.01)
*G05F 3/26* (2006.01)

(52) U.S. Cl.
CPC ..... *G05F 3/267* (2013.01)

(58) Field of Classification Search
CPC ... G05F 3/18; G05F 3/30; G05F 3/245; G05F 3/262; G05F 3/265
USPC ..... 323/271, 282–285, 299, 311–317
See application file for complete search history.

(56) References Cited

U.S. PATENT DOCUMENTS

| | | | | |
|---|---|---|---|---|
| 5,828,329 | A * | 10/1998 | Burns | G05F 3/225 323/315 |
| 6,204,724 | B1 * | 3/2001 | Kobatake | G05F 3/262 327/541 |
| 6,433,624 | B1 * | 8/2002 | Grossnickle | G05F 3/262 327/543 |
| 8,384,470 | B2 | 2/2013 | Sugiura | |
| 2016/0239029 | A1 * | 8/2016 | Ideno | H02H 9/04 |

FOREIGN PATENT DOCUMENTS

| | | |
|---|---|---|
| JP | 2007-148530 | 6/2007 |
| JP | 2011-211444 | 10/2011 |
| JP | 2013-054535 | 3/2013 |

* cited by examiner

*Primary Examiner* — Yemane Mehari
(74) *Attorney, Agent, or Firm* — Oblon, McClelland, Maier & Neustadt, L.L.P.

(57) ABSTRACT

According to one embodiment, a regulator is provided which comprises a reference voltage generating circuit that generates a reference voltage, a first voltage dividing circuit that divides a regulator output in voltage, an error amplifier that compares a first divided voltage obtained by dividing the regulator output and the reference voltage, and an output transistor that generates the regulator output based on the output of the error amplifier. The reference voltage generating circuit comprises a diode-connected first transistor. The reference voltage is generated based on a diode voltage generated by the first transistor.

18 Claims, 5 Drawing Sheets

REGULATOR AND SEMICONDUCTOR INTEGRATED CIRCUIT

CROSS-REFERENCE TO RELATED APPLICATIONS

This application is based upon and claims the benefit of priority from U.S. Provisional Application No. 62/133,125, filed on Mar. 13, 2015; the entire contents of which are incorporated herein by reference.

FIELD

Embodiments described herein relate generally to a regulator and semiconductor integrated circuit.

BACKGROUND

In regulators, in order to keep the output voltage constant, a reference voltage is generated by making a constant current flow through a resistor.

DETAILED DESCRIPTION

In general, according to one embodiment, a regulator comprises a reference voltage generating circuit that generates a reference voltage, a first voltage dividing circuit that divides a regulator output in voltage, an error amplifier that compares a first divided voltage obtained by dividing the regulator output and the reference voltage, and an output transistor that generates the regulator output based on the output of the error amplifier. The reference voltage generating circuit comprises a constant current source that generates a constant current, and a diode-connected first transistor having the constant current supplied thereto. The reference voltage is generated based on a diode voltage generated by the first transistor.

The regulators and semiconductor integrated circuits according to embodiments will be described in detail below with reference to the accompanying drawings. The present invention is not limited to these embodiments.

First Embodiment

Figure 1:
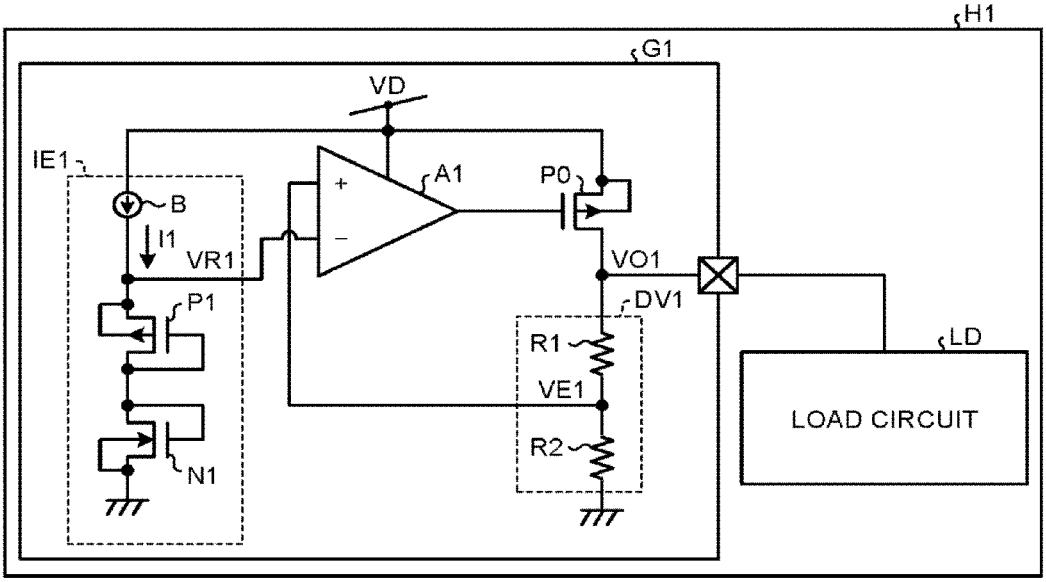
FIG. 1 is a circuit diagram showing the configuration of a regulator according to a first embodiment.

FIG. 1 is a circuit diagram showing the configuration of a regulator according to the first embodiment.

In FIG. 1, on a semiconductor chip H1, there are provided a regulator G1 and a load circuit LD. In the load circuit LD, there can be provided an integrated circuit including a CMOS circuit and the like. In the regulator G1, there are provided a reference voltage generating circuit IE1 that generates a reference voltage VR1, an error amplifier A1 that compares a divided voltage VE1 obtained by dividing a regulator output VO1 and the reference voltage VR1, an output transistor P0 that generates the regulator output VO1 based on the output of the error amplifier A1, and a voltage dividing circuit DV1 that divides the regulator output VO1. In the reference voltage generating circuit IE1, there are provided a constant current source B that generates a constant current I1, a diode-connected P-channel transistor P1, and a diode-connected N-channel transistor N1. Field-effect transistors can be used as the P-channel transistor P1 and N-channel transistor N1. The P-channel transistor P1 and N-channel transistor N1 are connected in series. The threshold voltages of the P-channel transistor P1 and N-channel transistor N1 can be made to coincide with those of P-channel transistors and N-channel transistors used in the load circuit LD by using transistors having the same type of threshold voltage as transistors used in the load circuit LD. In this case, the dimensions of the P-channel transistor P1 and N-channel transistor N1 are preferably set to be equal to those of P-channel transistors and N-channel transistors used in the load circuit LD. As these dimensions, the gate length, gate width, gate insulating film thickness, and so on can be cited. Where P-channel transistors having threshold voltages different from each other are used in the load circuit LD or N-channel transistors having threshold voltages different from each other are used, the average of the threshold voltages of P-channel transistors in the load circuit LD may be used as the threshold voltage of the P-channel transistor P1, or the average of the threshold voltages of N-channel transistors in the load circuit LD may be used as the threshold voltage of the N-channel transistor N1. Resistors R1, R2 are provided in the voltage dividing circuit DV1. The resistors R1, R2 are connected in series. A P-channel field-effect transistor can be used as the output transistor P0.

A power supply voltage VD is supplied to the constant current source B, the source of the output transistor P0, and the error amplifier A1. The regulator output VO1 is outputted via the drain of the output transistor P0 and used as the power supply voltage of the load circuit LD. The regulator output VO1 is divided by the resistors R1, R2, and the divided voltage VE1 is outputted via the connection point of the resistors R1, R2. This divided voltage VE1 is inputted to the non-inverting input terminal of the error amplifier A1. The constant current I1 is supplied from the constant current source B to the P-channel transistor P1 and N-channel transistor N1. The sum of the diode voltages of the P-channel transistor P1 and N-channel transistor N1 at this time is inputted as the reference voltage VR1 to the inverting input terminal of the error amplifier A1. The gate of the output transistor P0 is driven by the error amplifier A1 according to the difference between the reference voltage VR1 and the divided voltage VE1, and thus the output of the error amplifier A1 is set such that the difference between the reference voltage VR1 and the divided voltage VE1 approaches zero. Hence, the regulator output VO1 proportional to the reference voltage VR1 can be obtained. The proportionality constant for this can be adjusted through the division ratio of the resistors R1, R2.

Here, in the manufacture process of the semiconductor chips H1, variations occur in the threshold voltages of P-channel transistors and N-channel transistors used in the load circuit LD. In this situation, where the regulator output VO1 is constant, if the threshold voltages of P-channel transistors and N-channel transistors used in the load circuit LD become higher, then the operation margin of the load circuit LD becomes smaller, so that the performance decreases. On the other hand, if the threshold voltages of P-channel transistors and N-channel transistors used in the load circuit LD become lower, then the leakage current of the load circuit LD increases, so that the current consumption increases. The dimensions of the output transistor P0 are determined anticipating this increase in the current consumption when designing.

In contrast, by making the regulator output VO1 change according to variations in the threshold voltages of P-channel transistors and N-channel transistors used in the load circuit LD, a decrease in the operation margin of the load circuit LD and an increase in the current consumption can be suppressed. Since the regulator output VO1 is proportional to the reference voltage VR1, by making the reference voltage VR1 change according to variations in the threshold voltages of P-channel transistors and N-channel transistors used in the load circuit LD, the regulator output VO1 can be changed. In the configuration of FIG. 1, the reference voltage VR1 can be given by the sum of the diode voltages of the P-channel transistor P1 and N-channel transistor N1. The diode voltage of the P-channel transistor P1 depends on the threshold voltage of the P-channel transistor P1. The diode voltage of the N-channel transistor N1 depends on the threshold voltage of the N-channel transistor N1. By forming the regulator G1 and the load circuit LD on the same semiconductor chip H1, variations in the threshold voltages of P-channel transistors and N-channel transistors used in the load circuit LD can be reflected in the threshold voltages of the P-channel transistor P1 and N-channel transistor N1. Thus, the regulator output VO1 can be made to follow variations in the threshold voltages of P-channel transistors and N-channel transistors used in the load circuit LD so that the variations in the threshold voltages are absorbed, and hence a decrease in the operation margin of the load circuit LD and an increase in the current consumption can be suppressed. Further, because the dimensions of the output transistor P0 do not need to be increased anticipating an increase in the current consumption of the load circuit LD when the regulator output VO1 is constant, the dimensions of the output transistor P0 can be made smaller.

Second Embodiment

Figure 2:
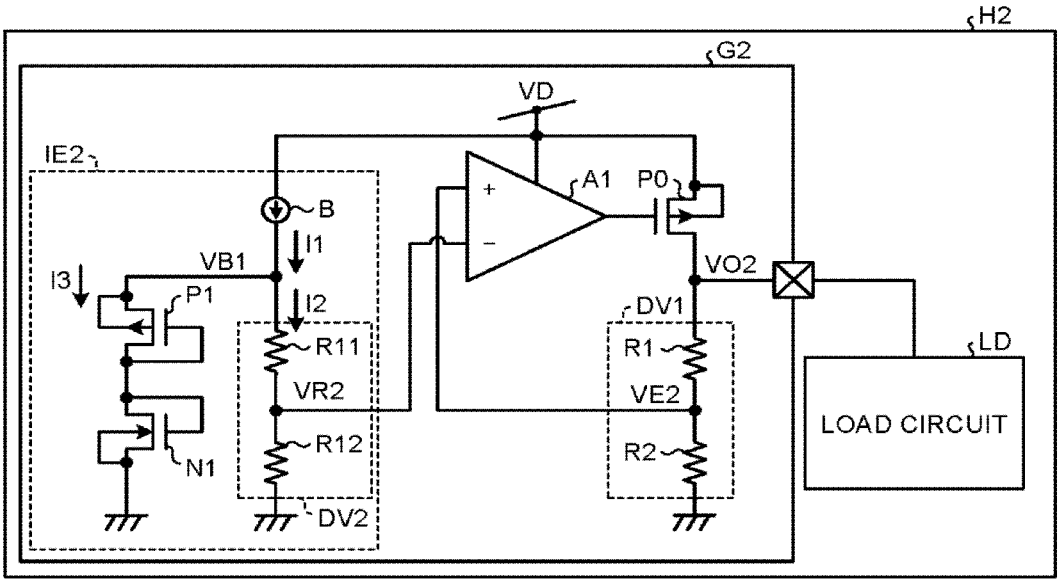
FIG. 2 is a circuit diagram showing the configuration of a regulator according to a second embodiment.

FIG. 2 is a circuit diagram showing the configuration of a regulator according to the second embodiment.

In FIG. 2, on a semiconductor chip H2, there are provided a regulator G2 and a load circuit LD. In the regulator G2, a reference voltage generating circuit IE2 is provided instead of the reference voltage generating circuit IE1 of the regulator G1 in FIG. 1. A voltage dividing circuit DV2 that divides a diode voltage VB1 is added to the reference voltage generating circuit IE2. Resistors R11, R12 are provided in the voltage dividing circuit DV2. The resistors R11, R12 are connected in series. Other than that, the regulator G2 can be configured in the same way as in FIG. 1.

A regulator output VO2 is outputted via the drain of the output transistor P0 and used as the power supply voltage of the load circuit LD. The regulator output VO2 is divided by the resistors R1, R2, and a divided voltage VE2 is outputted via the connection point of the resistors R1, R2. This divided voltage VE2 is inputted to the non-inverting input terminal of the error amplifier A1. The constant current I1 is outputted from the constant current source B, and a current I2 is supplied to the voltage dividing circuit DV2, and a current I3 is supplied to the P-channel transistor P1 and N-channel transistor N1. The diode voltage VB1 that is the sum of the diode voltages of the P-channel transistor P1 and N-channel transistor N1 at this time is divided by the resistors R11, R12, and a divided voltage outputted via the connection point of the resistors R11, R12 is inputted as a reference voltage VR2 to the inverting input terminal of the error amplifier A1. The gate of the output transistor P0 is driven by the error amplifier A1 according to the difference between the reference voltage VR2 and the divided voltage VE2, and thus the output of the error amplifier A1 is set such that the difference between the reference voltage VR2 and the divided voltage VE2 approaches zero.

Here, by connecting the resistors R11, R12 in parallel with the P-channel transistor P1 and N-channel transistor N1, the temperature dependence of the reference voltage VR2 can be made smaller than that of the reference voltage VR1, and thus the temperature dependence of the regulator output VO2 can be made smaller.

Third Embodiment

Figure 3:
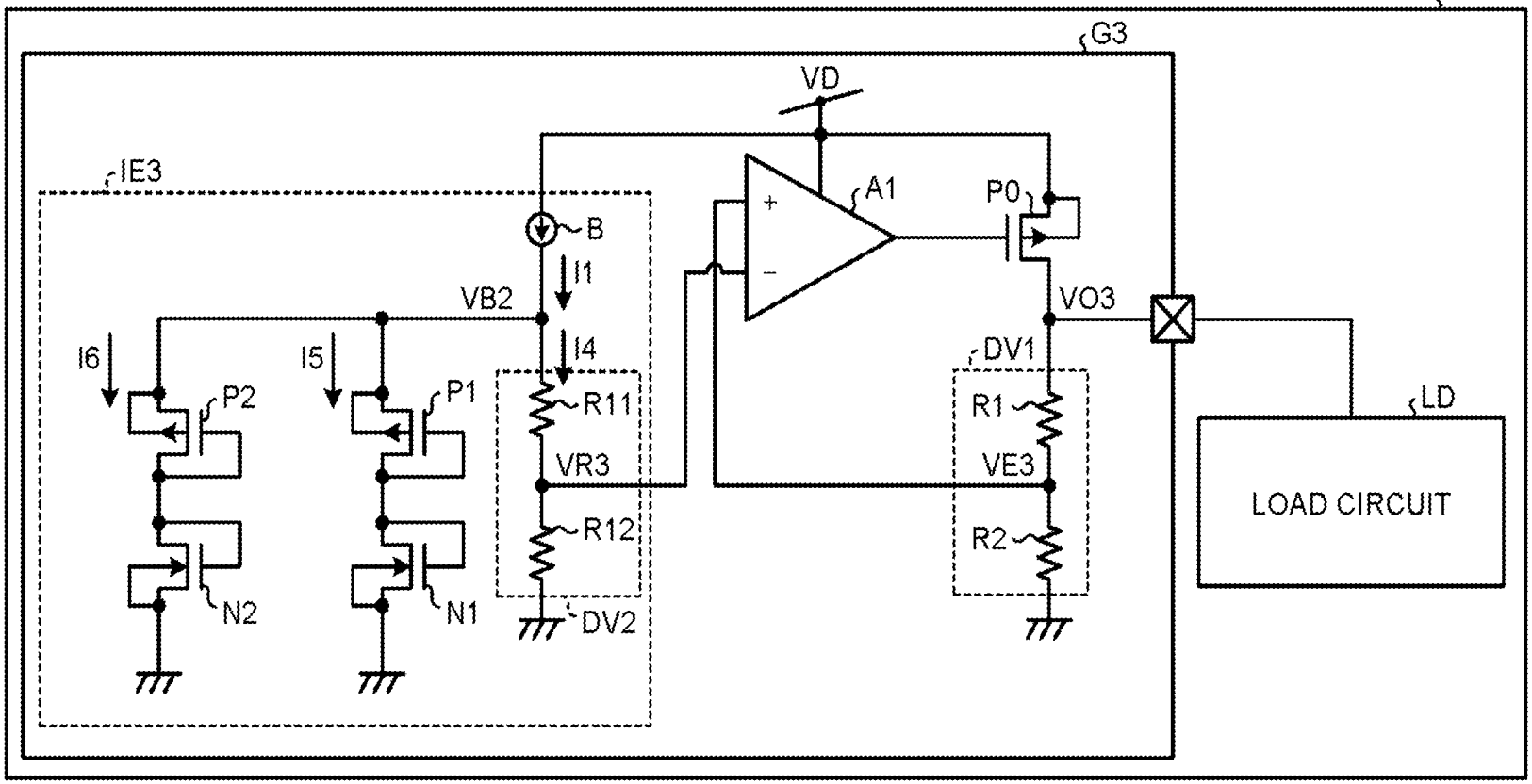
FIG. 3 is a circuit diagram showing the configuration of a regulator according to a third embodiment.

FIG. 3 is a circuit diagram showing the configuration of a regulator according to the third embodiment.

In FIG. 3, on a semiconductor chip H3, there are provided a regulator G3 and a load circuit LD. In the regulator G3, a reference voltage generating circuit IE3 is provided instead of the reference voltage generating circuit IE2 of the regulator G2 in FIG. 2. A diode-connected P-channel transistor P2 and a diode-connected N-channel transistor N2 is added to the reference voltage generating circuit IE3. The P-channel transistor P2 and N-channel transistor N2 are connected in series. The series circuit of the P-channel transistor P1 and N-channel transistor N1 can be connected in parallel with the series circuit of the P-channel transistor P2 and N-channel transistor N2. The threshold voltages of the P-channel transistor P2 and N-channel transistor N2 can be made different from the threshold voltages of the P-channel transistor P1 and N-channel transistor N1. Other than that, the regulator G3 can be configured in the same way as in FIG. 2.

A regulator output VO3 is outputted via the drain of the output transistor P0 and used as the power supply voltage of the load circuit LD. The regulator output VO3 is divided by the resistors R1, R2, and a divided voltage VE3 is outputted via the connection point of the resistors R1, R2. This divided voltage VE3 is inputted to the non-inverting input terminal of the error amplifier A1. The constant current I1 is outputted from the constant current source B; a current I4 is supplied to the voltage dividing circuit DV2; a current I5 is supplied to the P-channel transistor P1 and N-channel transistor N1; and a current I6 is supplied to the P-channel transistor P2 and N-channel transistor N2. The average VB2 of a diode voltage that is the sum of the diode voltages of the P-channel transistor P1 and N-channel transistor N1 at this time and of a diode voltage that is the sum of the diode voltages of the P-channel transistor P2 and N-channel transistor N2 at this time is divided by the resistors R11, R12, and a divided voltage outputted via the connection point of the resistors R11, R12 is inputted as a reference voltage VR3 to the inverting input terminal of the error amplifier A1. The gate of the output transistor P0 is driven by the error amplifier A1 according to the difference between the reference voltage VR3 and the divided voltage VE3, and thus the output of the error amplifier A1 is set such that the difference between the reference voltage VR3 and the divided voltage VE3 approaches zero.

Here, by using the average of the diode voltages of transistors having different threshold voltages as the reference voltage VR3, also where transistors having different threshold voltages are used in the load circuit LD, the accuracy of the regulator output VO3 in following variations can be improved so that the variations in those threshold voltages are effectively absorbed.

Fourth Embodiment

Figure 4:
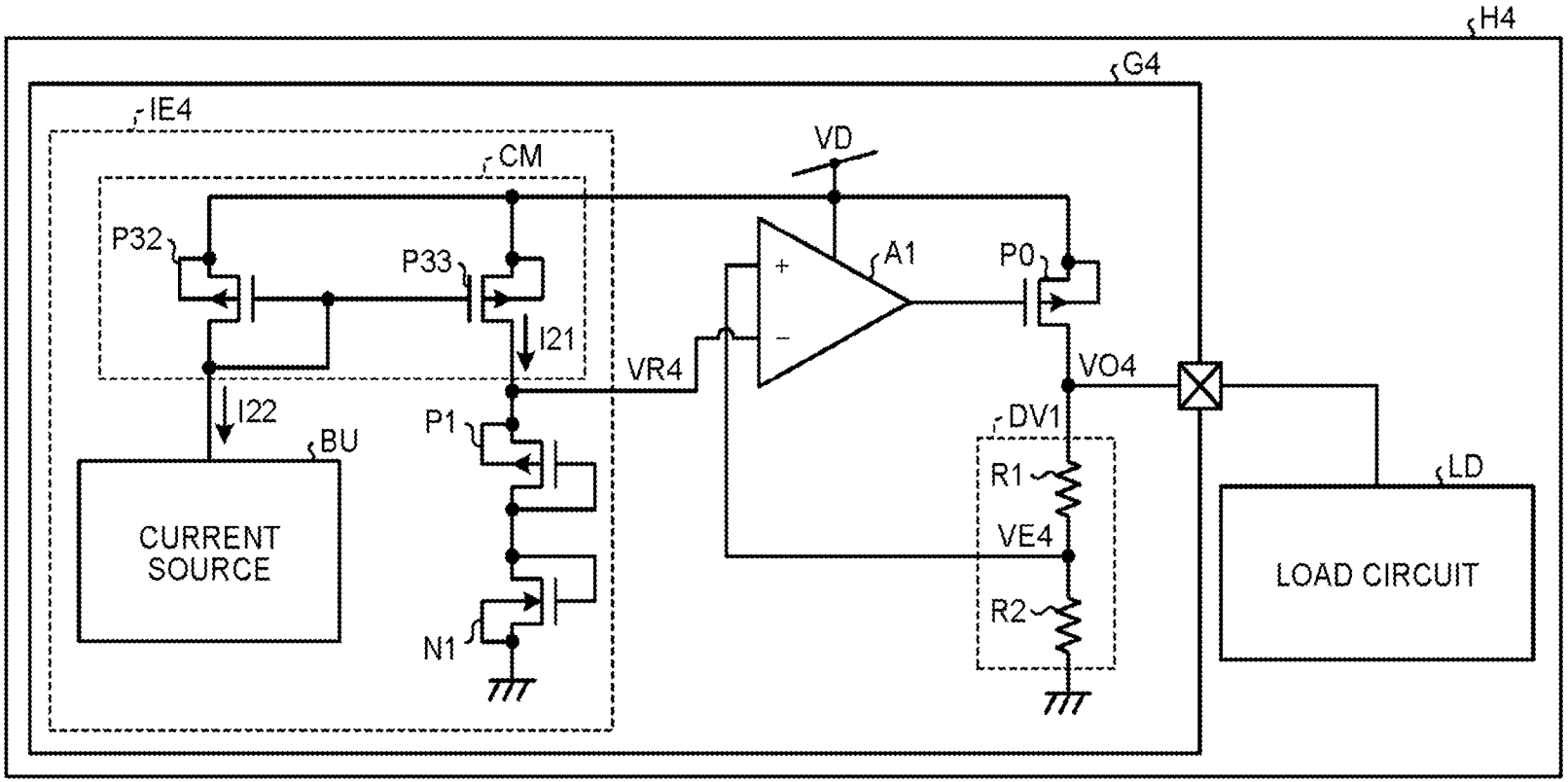
FIG. 4 is a circuit diagram showing the configuration of a regulator according to a fourth embodiment.

FIG. 4 is a circuit diagram showing the configuration of a regulator according to the fourth embodiment.

In FIG. 4, on a semiconductor chip H4, there are provided a regulator G4 and a load circuit LD. In the regulator G4, a reference voltage generating circuit IE4 is provided instead of the reference voltage generating circuit IE1 of the regulator G1 in FIG. 1. In the reference voltage generating circuit IE4, a current source BU whose temperature characteristic is adjustable and a current mirror circuit CM that performs current mirror operation for a constant current I22 generated by the current source BU are provided instead of the constant current source B of FIG. 1. The current source BU can reduce the temperature dependence of a constant current I21. P-channel transistors P32, P33 are provided in the current mirror circuit CM. The gates of the P-channel transistors P32, P33 are connected to the drain of the P-channel transistor P32. The power supply voltage VD is supplied to the sources of the P-channel transistors P32, P33.

A regulator output VO4 is outputted via the drain of the output transistor P0 and used as the power supply voltage of the load circuit LD. The regulator output VO4 is divided by the resistors R1, R2, and a divided voltage VE4 is outputted via the connection point of the resistors R1, R2. This divided voltage VE4 is inputted to the non-inverting input terminal of the error amplifier A1. The constant current I22 is generated by the current source BU and inputted to the current mirror circuit CM. In the current mirror circuit CM, current mirror operation for a constant current I22 is performed, so that the constant current I21 is generated and supplied to the P-channel transistor P1 and N-channel transistor N1. A diode voltage that is the sum of the diode voltages of the P-channel transistor P1 and N-channel transistor N1 at this time is inputted as a reference voltage VR4 to the inverting input terminal of the error amplifier A1. The gate of the output transistor P0 is driven by the error amplifier A1 according to the difference between the reference voltage VR4 and the divided voltage VE4, and thus the output of the error amplifier A1 is set such that the difference between the reference voltage VR4 and the divided voltage VE4 approaches zero.

Here, by reducing the temperature dependence of a constant current I21, the temperature characteristic of only the P-channel transistor P1 and N-channel transistor N1 can be reflected in the reference voltage VR4. Thus, the correspondence between the temperature characteristic of the P-channel transistors and N-channel transistors used in the load circuit LD and the temperature characteristic of the reference voltage VR4 can be made highly accurate, and therefore the accuracy of the regulator output VO4 in following variations can be improved so that the variations in their threshold voltages are effectively absorbed.

Although the voltage dividing circuit DV2 of FIG. 2 is not provided in the example of FIG. 4, the voltage dividing circuit DV2 of FIG. 2 may be provided.

Figure 5:
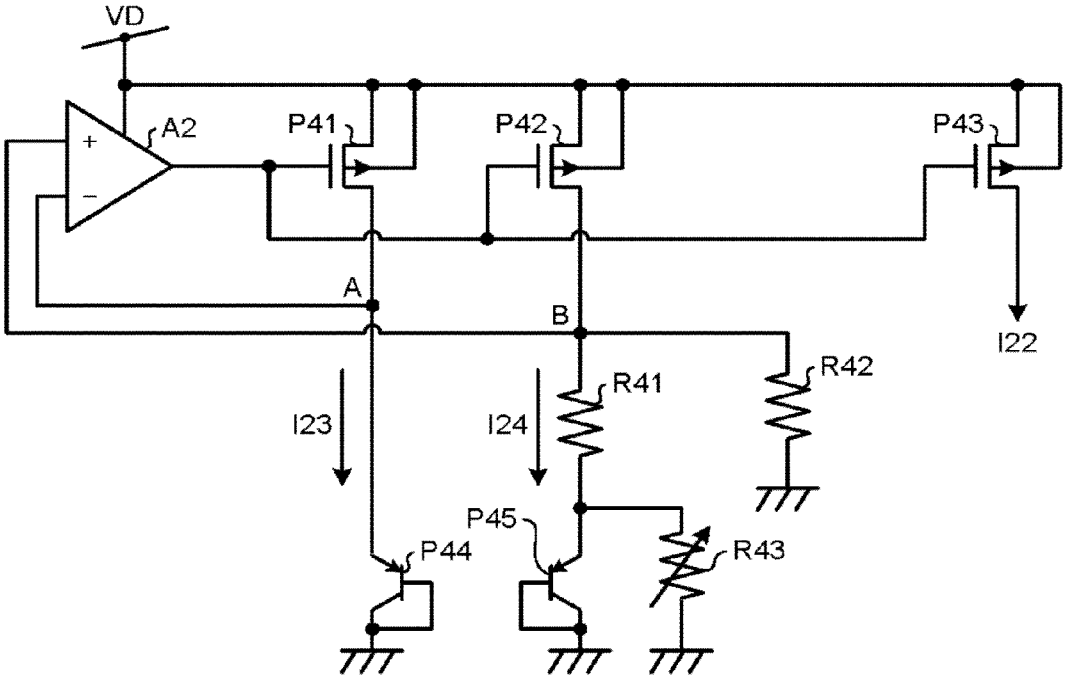
FIG. 5 is a circuit diagram showing the configuration of the current source of FIG. 4.

FIG. 5 is a circuit diagram showing the configuration of the current source of FIG. 4.

In FIG. 5, in this current source BU, there are provided an error amplifier A2, P-channel transistors P41 to P45, resistors R41, R42, and a variable resistor R43. Field-effect transistors can be used as the P-channel transistors P41 to P43, and bipolar transistors can be used as the P-channel transistors P44, P45. The P-channel transistors P41, P44 are connected in series, and the resistor R41 and the P-channel transistors P42, P45 are connected in series. The connection point of the P-channel transistors P41, P44 is connected to the inverting input terminal of the error amplifier A2, and the connection point of the resistor R41 and the P-channel transistor P42 is connected to the non-inverting input terminal of the error amplifier A2. Further, the resistor R42 is connected to the connection point of the resistor R41 and the P-channel transistor P42, and the variable resistor R43 is connected to the connection point of the resistor R41 and the P-channel transistor P45. The output of the error amplifier A2 is connected to the gates of the P-channel transistors P41 to P43. The power supply voltage VD is supplied to the error amplifier A2 and the sources of the P-channel transistors P41 to P43.

The inverting input potential A of the error amplifier A2 is set by a current I23 flowing through the P-channel transistor P44, and the non-inverting input potential B of the error amplifier A2 is set by a current I24 flowing through the resistor R41 and distributed to the P-channel transistor P45 and the variable resistor R43. The output of the error amplifier A2 is set according to the difference between the inverting input potential A and the non-inverting input potential B, and the gate of the P-channel transistor P43 is driven by that output to generate the constant current I22. At this time, since the P-channel transistors P44, P45 have a temperature characteristic, the inverting input potential A and the non-inverting input potential B vary due to temperature change. Because the variable resistor R43 is connected in parallel with the P-channel transistor P45, a variation in the non-inverting input potential B due to the temperature characteristic of the P-channel transistor P45 can be adjusted for by varying the variable resistor R43. At this time, by adjusting the variable resistor R43, the temperature characteristic curve of the P-channel transistor P45 can be made to coincide with that of the P-channel transistor P44. Thus, in the error amplifier A2, a variation in the inverting input potential A and a variation in the non-inverting input potential B due to temperature change can be made to cancel out, so that the temperature dependence of the constant current I22 can be reduced.

Fifth Embodiment

Figure 6:
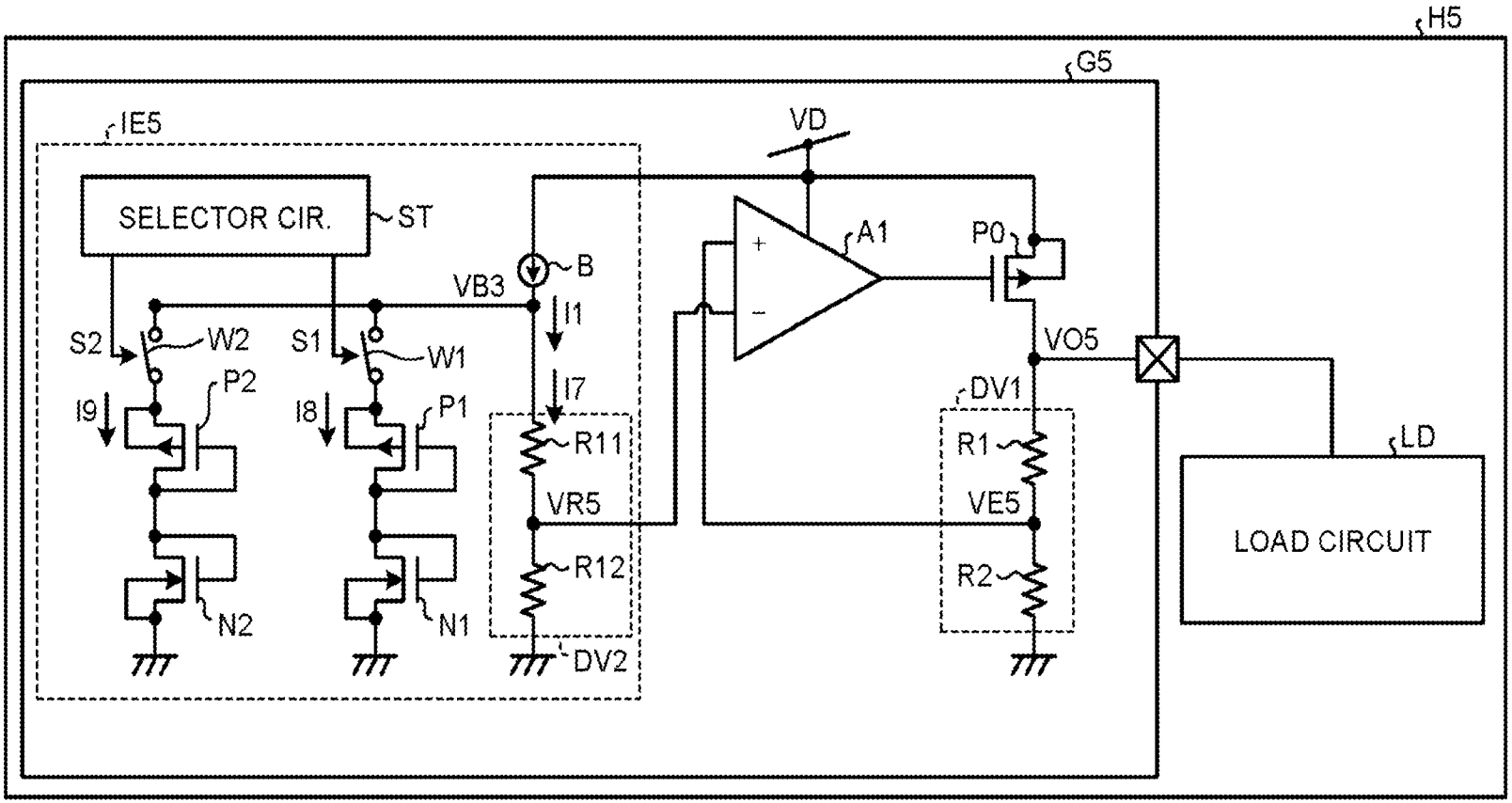
FIG. 6 is a circuit diagram showing the configuration of a regulator according to a fifth embodiment.

FIG. 6 is a circuit diagram showing the configuration of a regulator according to the fifth embodiment.

In FIG. 6, on a semiconductor chip H5, there are provided a regulator G5 and a load circuit LD. In the regulator G5, a reference voltage generating circuit IE5 is provided instead of the reference voltage generating circuit IE3 of the regulator G3 in FIG. 3. Switches W1, W2 and a selector circuit ST are added to the reference voltage generating circuit IE5. The switch W1 is provided between a series circuit of a P-channel transistor P1 and N-channel transistor N1 and a constant current source B. The switch W2 is provided between a series circuit of a P-channel transistor P2 and N-channel transistor N2 and the constant current source B. The selector circuit ST outputs selecting signals S1, S2 to the switches W1, W2 to set the switches W1, W2 to be on or off. The selector circuit ST may be constituted by fuses, an EEPROM, or a logic circuit.

The regulator G5 and load circuit LD can be made to operate according to the on/off states of the switches W1, W2, and the on/off states of the switches W1, W2 can be registered in the selector circuit ST so as to optimize a regulator output VO5.

The regulator output VO5 is outputted via the drain of the output transistor P0 and used as the power supply voltage of the load circuit LD. The regulator output VO5 is divided by the resistors R1, R2, and a divided voltage VE5 is outputted via the connection point of the resistors R1, R2. This divided voltage VE5 is inputted to the non-inverting input terminal of the error amplifier A1. A constant current I1 is outputted from the constant current source B, and a current I7 is supplied to a voltage dividing circuit DV2. If the switch W1 is turned on, a current I8 is supplied to the P-channel transistor P1 and N-channel transistor N1. If the switch W2 is turned on, a current I9 is supplied to the P-channel transistor P2 and N-channel transistor N2. A diode voltage that is the sum of the diode voltages of the P-channel transistor P1 and N-channel transistor N1 or a diode voltage that is the sum of the diode voltages of the P-channel transistor P2 and N-channel transistor N2 is divided by the resistors R11, R12 depending on the on/off of the switches W1, W2, and a divided voltage outputted via the connection point of the resistors R11, R12 is inputted as a reference voltage VR5 to the inverting input terminal of the error amplifier A1. The gate of the output transistor P0 is driven by the error amplifier A1 according to the difference between the reference voltage VR5 and the divided voltage VE5, and thus the output of the error amplifier A1 is set such that the difference between the reference voltage VR5 and the divided voltage VE5 approaches zero.

Here, by optimizing the regulator output VO5 based on the actual operation state of the regulator G5 and the load circuit LD, a decrease in the operation margin of the load circuit LD and an increase in the current consumption can be suppressed even if the load circuit LD operates in an unexpected manner according to variations in the threshold voltages of P-channel transistors and N-channel transistors used in the load circuit LD. Further, also where the regulator G5 and the load circuit LD are incorporated in separate chips, or so on, so that the variation distribution of the threshold voltages of the P-channel transistor P1 and N-channel transistor N1 used in the regulator G5 and the variation distribution of the threshold voltages of P-channel transistors and N-channel transistors used in the load circuit LD are different, the regulator output VO5 can be optimized.

Although in the above embodiment the configuration is shown where only two series circuits of the diode-connected P-channel transistor and diode-connected N-channel transistor connected in series are connected in parallel, M number (M is an integer of two or greater) of series circuits of the diode-connected P-channel transistor and diode-connected N-channel transistor connected in series may be connected in parallel. In this case, the threshold voltages of the P-channel transistor and N-channel transistor can be set to be different for each series circuit. Further, the current source BU and the current mirror circuit CM of FIG. 4 may be used instead of the constant current source B of FIGS. 1, 2, 3, and 6.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A regulator comprising:
- a reference voltage generating circuit that generates a reference voltage;
- a first voltage dividing circuit that divides a regulator output in voltage;
- an error amplifier that compares a first divided voltage obtained by dividing the regulator output and the reference voltage; and
- an output transistor that generates the regulator output based on the output of the error amplifier,
- wherein the reference voltage generating circuit comprises:
  - a constant current source that generates a constant current; and
  - a diode-connected first transistor having the constant current supplied thereto,
- wherein the reference voltage is generated based on a diode voltage generated by the first transistor, the first transistor comprising:
  - a diode-connected P-channel transistor; and
  - a diode-connected N-channel transistor connected in series to the P-channel transistor, and
- wherein the diode voltage of the first transistor is given by the sum of the diode voltage of the P-channel transistor and the diode voltage of the N-channel transistor.

2. The regulator according to claim 1, wherein the first voltage dividing circuit comprises:
- a first resistor; and
- a second resistor connected in series to the first resistor, and
- wherein the first divided voltage is outputted via the connection point of the first resistor and the second resistor.

3. The regulator according to claim 1, comprising:
- a second voltage dividing circuit that divides the diode voltage of the first transistor,
- wherein the reference voltage is a second divided voltage obtained by dividing the diode voltage of the first transistor.

4. The regulator according to claim 3, wherein the second voltage dividing circuit comprises:
- a third resistor; and
- a fourth resistor connected in series to the third resistor, and
- wherein the second divided voltage is outputted via the connection point of the third resistor and the fourth resistor.

5. The regulator according to claim 1, wherein the first transistor comprises:
- M number (M is an integer of two or greater) of series circuits of a diode-connected P-channel transistor and a diode-connected N-channel transistor connected in series that are connected in parallel,
- wherein the threshold voltages of the P-channel transistor and the N-channel transistor are set to be different for each of the series circuits, and
- wherein the diode voltage of the first transistor is a voltage on a connection point of the parallel connection.

6. The regulator according to claim 5, comprising a selector circuit that selects one or a number, no greater than M−1, of series circuits from the M number of series circuits.

7. The regulator according to claim 6, wherein the selector circuit selects the series circuits according to thresholds of P-channel transistors and N-channel transistors of a load circuit to which the regulator output is supplied.

8. The regulator according to claim 1, wherein the constant current source comprises:

a current source whose temperature characteristic is adjustable; and a current mirror circuit that performs current mirror operation for a current generated by the current source to generate the constant current.

9. The regulator according to claim 8, wherein the current source comprises a variable resistor that can be adjusted to reduce the temperature dependence of the constant current.

10. A semiconductor integrated circuit comprising:

a reference voltage generating circuit that generates a reference voltage;

a first voltage dividing circuit that divides a regulator output in voltage;

an error amplifier that compares a first divided voltage obtained by dividing the regulator output and the reference voltage;

an output transistor that generates the regulator output based on the output of the error amplifier; and a load circuit to which the regulator output is supplied, wherein the reference voltage generating circuit comprises:

a constant current source that generates a constant current; and a diode-connected first transistor having the constant current supplied thereto, wherein the reference voltage is generated based on a diode voltage generated by the first transistor, the first transistor comprising:

a diode-connected P-channel transistor; and a diode-connected N-channel transistor connected in series to the P-channel transistor, and wherein the diode voltage of the first transistor is given by the sum of the diode voltage of the P-channel transistor and the diode voltage of the N-channel transistor.

11. The semiconductor integrated circuit according to claim 10, wherein the reference voltage generating circuit, the first voltage dividing circuit, the error amplifier, the output transistor, and the load circuit are formed on the same semiconductor chip.

12. The semiconductor integrated circuit according to claim 11, wherein the first voltage dividing circuit comprises:

a first resistor; and a second resistor connected in series to the first resistor, and wherein the first divided voltage is outputted via the connection point of the first resistor and the second resistor.

13. The semiconductor integrated circuit according to claim 11, comprising:

a second voltage dividing circuit that divides the diode voltage of the first transistor, wherein the reference voltage is a second divided voltage obtained by dividing the diode voltage of the first transistor.

14. The semiconductor integrated circuit according to claim 13, wherein the second voltage dividing circuit comprises:

a third resistor; and a fourth resistor connected in series to the third resistor, and wherein the second divided voltage is outputted via the connection point of the third resistor and the fourth resistor.

15. The semiconductor integrated circuit according to claim 11, wherein the constant current source comprises:

a current source whose temperature characteristic is adjustable; and a current mirror circuit that performs current mirror operation for a current generated by the current source to generate the constant current.

16. The semiconductor integrated circuit according to claim 15, wherein the current source comprises a variable resistor that can be adjusted to reduce the temperature dependence of the constant current.

17. The semiconductor integrated circuit according to claim 10, wherein the first transistor comprises:

M number (M is an integer of two or greater) of series circuits of a diode-connected P-channel transistor and a diode-connected N-channel transistor connected in series that are connected in parallel, wherein the threshold voltages of the P-channel transistor and the N-channel transistor are set to be different for each of the series circuits, and wherein the diode voltage of the first transistor is a voltage on a connection point of the parallel connection.

18. The semiconductor integrated circuit according to claim 10, comprising a selector circuit that selects one or a number, no greater than M−1, of series circuits from the M number of series circuits.

* * * * *